US006781292B2

(12) United States Patent
Ishida et al.

(10) Patent No.: US 6,781,292 B2
(45) Date of Patent: Aug. 24, 2004

(54) HIGH PRESSURE DISCHARGE LAMP AND LUMINAIRE

(75) Inventors: Masazumi Ishida, Kanagawa-ken (JP); Sadao Sakaguchi, Kanagawa-ken (JP); Shigemi Oku, Kanagawa-ken (JP); Takahito Kashiwagi, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/354,114

(22) Filed: Jan. 30, 2003

(65) Prior Publication Data

US 2003/0141797 A1 Jul. 31, 2003

(30) Foreign Application Priority Data

Jan. 30, 2002 (JP) ..... 2002-021349
Nov. 29, 2002 (JP) ..... 2002-348003

(51) Int. Cl.[7] ..... H01J 61/36
(52) U.S. Cl. ..... 313/284; 313/625; 313/570
(58) Field of Search ..... 313/283–286, 313/624, 625, 570, 572, 288

(56) References Cited

U.S. PATENT DOCUMENTS

2002/0135304 A1 * 9/2002 Honda et al. ..... 313/634

FOREIGN PATENT DOCUMENTS

| | | |
|---|---|---|
| JP | 10-83796 | 3/1998 |
| JP | 10-284004 | 10/1998 |
| JP | 2001-76677 | 3/2001 |

* cited by examiner

*Primary Examiner*—Vip Patel
*Assistant Examiner*—Glenn Zimmerman
(74) *Attorney, Agent, or Firm*—Pillsbury Winthrop LLP

(57) ABSTRACT

A high-pressure discharge lamp which includes a translucent ceramic discharge vessel having a swollen portion defining a discharge space and a pair of cylindrical portions formed in and communicating with the swollen portion and extending from the swollen portion in the opposite directions with each other. The high-pressure discharge lamp also includes metal tubes each having a outer diameter D and fit with its one end on the cylindrical portion, a pair of fusible metal plugs each plugged in the outer end of the metal tube, the fusible metal plug sealing the discharge vessel by being fused to the inner surface of the metal tube for a specified height T from the outer end of the metal plug, a pair of electrode systems each supported its one end to the fusible metal plug and facing the interior of swollen portion with its other end, and ionizing filling filled in the discharge vessel The ratio T/D of the height T concerning the fusible metal plug and the diameter D satisfies the following equation $0.40 \leqq T/D \leqq 0.95$.

8 Claims, 9 Drawing Sheets

HIGH PRESSURE DISCHARGE LAMP AND LUMINAIRE

CROSS-REFERENCE TO RELATED APPLICATIONS

This application is based upon and claims the benefit of priority from the prior Japanese Patent Applications JP2002-348003 filed Nov. 29, 2002 and JP2002-21349 filed on Jan. 30, 2002, the entire contents of which are incorporated herein by reference.

FIELD OF THE INVENTION

The present invention relates to a high-pressure discharge lamp having a translucent ceramic discharge vessel, and a luminaire using such a discharge lamp.

BACKGROUND OF THE INVENTION

Developments for high-pressure discharge lamps have been widely continued since high-pressure discharge lamps are characterized by properties of high efficiency and long life of time.

Especially, a compact single-based metal halide lamp with a rated lamp wattage of about 10–30 W have been developed in recent-years as lighting sources for halogen lamps such as compact single-based high-pressure discharge lamps and headlights.

Such a compact single-based metal halide lamp is known in the conventional arts, JP-10-284004-A, JP-10-83796-A, JP-2001-76677-A, etc.

Such a conventional compact single-based metal halide lamp typically comprises, a translucent ceramic discharge vessel having a pair of cylindrical portions formed in communicating with a swollen portion at its opposite sides, the cylindrical portions respectively having an inner diameter shorter than that of the swollen portion, a pair of metal tubes each fit in the cylindrical portion, a pair of fusible metal plugs each closing the open end of the metal tube thereby an electrode supported to the metal plug facing the interior of the swollen portion, and ionizing filling such as halide, mercury, or rare gas filled in the discharge vessel.

Such a conventional compact single-based metal halide lamp has a lamp efficiency higher than halogen lamps by three to four times. Moreover, the size is remarkably smaller than compact single-based fluorescent lamps. Therefore, the compact single-based metal halide lamp can be used as a point source, and thus it is supposed as an arc tube for novel lighting system other than compact single-based high-pressure discharge lamps and headlights.

However, such a conventional compact single-based metal halide lamp still has a problem of spoiling the reliability on the lamp life time by leaks taking place at the sealing portion due to an incomplete fitting of the fusible metal plug to the open end of the metal tube and a difference between coefficient-of-thermal-expansions of the fusible metal plug and the metal tube.

Although such a problem of leaks occurring at the sealing portion could be avoided by, for example, lengthening the metal tube so as that the temperature of the sealing portion of the metal tube. However, there still remains a problem of that the size of the discharge lamp cannot be reduced.

SUMMARY OF THE INVENTION

In order to solve the above problems, an object of the present invention is to provide a high-pressure discharge lamp with less leaks of ionizing filling and thus capable of maintaining a high reliability for a long time and a luminaire equipped with such a high-pressure discharge lamp. Another object of the present invention is to provide a fixture, which having heat conductive member cools the fluorescent lamp effectively.

A translucent ceramic discharge vessel according to the one aspect of the invention comprises, a translucent ceramic discharge vessel having a swollen portion defining a discharge space and a pair of cylindrical portions formed in communicating with the swollen portion and extending from the swollen portion in the opposite directions with each other, metal tubes each having a outer diameter D and fit with its one end on the cylindrical portion, a pair of fusible metal plugs each plugged in the outer end of the metal tube, the fusible metal plug sealing the discharge vessel by being fused to the inner surface of the metal tube for a specified height T from the outer end of the metal plug, a pair of electrode systems each supported its one and to the fusible metal plug and facing the interior of swollen portion with its other end and ionizing filling filled in the discharge vessel, wherein the ratio T/D of the height T concerning the fusible metal plug and the diameter D satisfies the following equation.

$$0.40 \leqq T/D \leqq 0.95$$

In this application, some definitions and their technical meanings are presented for following specific terms, unless otherwise specified.

A discharge vessel defining discharge space has a swollen portion in a shape of spherical, oval, ellipse or cylindrical, and a pair of cylindrical portions extending from the swollen portion in the opposite directions with each other. The swollen portion and the pair of cylindrical portions may be formed in integral or may be separately formed and after that coupled together.

The ceramic material making the discharge lamp may be sapphire, aluminium oxide (Al2O3), yttrium aluminium garnet (YAG), yttrium oxide (YOx), or aluminium nitride (AlN) which has a translucency and a heat-resistivity.

The term "translucency" means an optical permeability in an order or penetrating outside a light generated by a discharge. Thus, it may not be restricted to be transparent, but may be diffusible. Although the swollen portion must be translucent, the cylindrical portions may simply have a light blocking effect.

In order to make the high-pressure discharge lamp compact, it is favorable that the internal volume of the discharge vessel is 0.06 cc or less, and more favorably it is 0.04 cc or less. It is favorable that the overall length of the discharge vessel is 35 mm or less, and more favorably it is in the range of 10–30 mm.

The metal tube is made of high melting point metal such as Molybdenum or Tungsten, which has a high corrosion resistance against the ionizing filling, and a high adhesiveness with the ceramics.

The metal tube is fixed to the inner surface or the outer surface of the cylindrical portion through a cermet, or a combination of cermet and sealing compound for ceramics. The fusible metal plug is plugged in the open end of the cylindrical portion after the ionizing filling has been filled in the discharge vessel. An electrode system is supported on the inner end of the fusible metal plug so as that an electrode formed on the end of the electrode system faces the interior of the swollen portion.

Fusible metals, such as platinum (melting point; 1772° C.), vanadium (melting point; 1980° C.) or Molybdenum (melting point; 2610° C.) which has a thermal expansion coefficient close to that of the metal tube or any alloy with either one of those can be used for the fusing metal plug. When the metal tube is made of Molybdenum and the open end is closed by fusing the end portion, the metal tube can also serve as the fusing metal plug.

The fusion of the fusible metal plug is carried out by applying a high-power energy of such a YAG laser, a CO2 laser or an electron beam.

In case of that the metal tube is fit on the inner surface of the cylindrical portion, if the ratio BD/PL, of the maximum inner diameter BD of the discharge vessel to tho distance PL between the center of the discharge vessel and the inner end of the metal tube is in the range of 0.5–1.5, the efficiency of the discharge lamp will increase. And also, leaks caused by the exfoliation or the metal tube from the cylindrical portion can be prevented.

That is, the ratio BD/PL less than 0.5 are unfavorable, since it causes the temperature of the coldest portion to lower and thus decreasing the lighting efficiency. On the other hand, the ratio BD/PL in excess of 1.5 also unfavorable, since it causes an excessive temperature rise in the scaling portion, and thus causing leaks in the sealing portion.

In each electrode system, the electrode provided on the tip end of the electrode rod faces the interior of the discharge vessel. While the electrode rod is fixed to the fusible metal plug by being the other end of the electrode rod embedded or welded to the fusible metal plug.

The electrode rod is made of high melting point metal such as Tungsten, doped-Tungsten, Tungsten containing rhenium, or Molybdenum. The electrode is formed in a shape of coil wound on the tip end or the electrode rod. It is permissible that the electrode rod itself serves as the electrode. It is also permissible that the pair of electrode systems may be either of symmetrical or asymmetrical in their shape or size.

The ionizing filling contains luminous-metal gas, ramp voltage regulating gas and starting gas and buffer gas. For the luminous-metal gas and the ramp voltage regulating gas, metal halide made or one or more elements selected from sodium, lithium, scandium, rare earth metal, mercury or amalgam are used. The starting gas and/or the buffer gas are made of any one or a combination of rare gases such as xenon, argon, krypton and neon, and filled in the discharge vessel to exhibit a pressure more than one atmospheric pressure during lighting.

In the present invention, the starting voltage can be reduced by placing a starting-aid conductor, as needed.

The high-pressure discharge lamp according to the present invention is able to be lighted in a state that the translucent ceramic discharge vessel is exposed into air. The high-pressure discharge lamp can be formed in a double-bulb type lamp or a multiple-bulb type lamp wherein the ceramic discharge vessel is enclosed in a jacket tube made of translucent and heat-resistive hard glass such as quartz glass or borosilicate glass.

Furthermore, getters, such as Zr-aluminum alloy which makes the inside of the jacket bulb clean, can be provided on feeders etc. in the jacket bulb.

In a high-pressure discharge lamps according to one aspect of the invention a discharge vessel is formed in the swollen portion and the pair of cylindrical portions, and a high-pressure discharge lamp according to the present invention is supporting an electrode system while sealing a discharge vessel with a fusible metal plug inserted in an outside end of a metal tube joined to each cylindrical portion.

When the ratio T/D of the height T concerning the fusible metal plug and the diameter D of the cylindrical portion is in the range of 0.40–0.95, leaks taking place by exfoliation due to the thermal-expansion coefficient difference of the fusible metal plug and the metal tube, or voids leaks by voids taking place in the fusible metal plug decreases. Therefore the shortening of lamp life can be restraint.

If the ratio T/D is less than 0.4, voids taking place in the fusible metal plug by any reason communicate each other. Thus there arises a fear of that leaks take place. Moreover, if the ratio T/D is in excess of 0.95, and the surrounding height T may become too high, and ratio T/D may produce exfoliation by thermal-expansion coefficient difference with a metal tube increases. Since the heat capacity becomes large and thus the temperature of a fusible metal plug becomes difficult to rise, the fusible metal plug and the metal tube cannot be sufficiently welded together and thus cause a leaks from the interface between them.

As described above, a high-pressure discharge lamp according to one aspect of the invention can repress cracks generated in the once-fused portion of fusible metal plug and a metal tube due to degradation of a fusible metal plug by erosion of ionizing filling such as halide filled in the discharge vessel, and thermal shock at the time of turning ON or OFF the lamp by specifying the ratio T/D of the height T concerning the fusible metal plug and the outer diameter D.

A high-pressure discharge lamp according to another aspect of the invention is characterized by that the metal tube is principally made of high melting point metal such as Tungsten or Molybdenum.

Since Molybdenum and Tungsten have high corrosion resistance against ionizing filling and a thermal expansion coefficient close to that of the translucent ceramic discharge vessel, the discharge lamp according to this aspect of the invention is able to achieve the same effect as that achieved by the above-mentioned high-pressure discharge lamp.

The metal tube is fixed to the inner surface or the outer surface of the cylindrical portion through a cermet, or a combination of cermet and sealing compound for ceramics. The fusible metal plug is plugged in the open end of the cylindrical portion after the ionizing filling has been filled in the discharge vessel. Then the electrode on the electrode system is positioned in the discharge vessel by being suspended to the fusible metal plug.

A high-pressure discharge lamp according to still another aspect of the invention is characterized by that the diameter D is in the range 0.6–1.6 mm.

If the diameter D of the metal tube is less than 0.6 mm, and accordingly the electrode rod becomes thinner, there arises a fear of causing an excessive temperature rise in the electrode. If the diameter D or the metal tube is in excess of 1.6 mm, the wall-thickness of the cylindrical portion becomes thinner in relative to the diameter of the cylindrical portion at the portion around the metal tube. Then the strength of the cylindrical portion falls off. Thus there arises a problem that cracks take place in the cylindrical portion.

A high-pressure discharge lamp according to still another aspect of the invention is characterized by that the height T concerning the fusible metal plug is in the range of 0.24–1.5 mm.

If the height T concerning the fusible metal plug is less than 0.24 mm, the fusible metal plug cannot withstand a pressure rise in the discharge vessel at the time of turning ON the lamp. Then there arises a fear of causing leak through the damaged fusible metal plug. If the height T concerning the fusible metal plug is in excess of 1.5 mm, the heat capacity of the fusible metal plug increases therewith.

Then an amount of heat required for fusing the fusible metal plug also increases. Thus there arises a problem that cracks tend to take place.

Here, a distance that a fused part of the fusible metal plug flows down is small, since the diameter of the metal tube is relatively small. Then the flowing-down distance is almost uniform in the circumferential direction. That is, the dispersion of the flowing-down distance is small. Thus the measurement of the height T concerning the fusible metal plug is easily carried out. However, if the dispersion of the flowing-down distance is large, it is able to adopt an intermediate value of the dispersed values of the flowing-down distance.

A high-pressure discharge lamp according to still another aspect of the invention is characterized by that the fusible metal plug is principally made of fusible metal such as Platinum, Vanadium or Molybdenum.

Even if a thermal-expansion coefficient difference with a tube ingredient is little by choosing a fusible metal plug which blockades an open end of a metal tube from a fusible metal which makes platinum, vanadium, or Molybdenum a principal component as mentioned above, and it receives a thermal shock, it can repress that exfoliation arises in both interface.

These fusible metals should just be in a ratio T/D of the height T concerning the fusible metal plug after solidification and the outer diameter D of a metal tube was indicated to be by the claim 1, although flowing-down distance of a fusible metal fused since each melting point differs from other.

A high-pressure discharge lamp according to still another aspect of the invention is characterized by farther comprising a heat-resistive and translucent jacket bulb enclosing therein the translucent ceramic discharge vessel sealed with the metal tube and the fusible metal plug.

According to this high-pressure discharge lamp further comprising the jacket bulb, an oxidization of elements in the translucent ceramic discharge vessel whose temperatures particularly rises during lighting of the lamp or a corruption of the translucent ceramic discharge vessel can be prevented. Thereby the handleability and the safety of the discharge lamp can be extensively improved.

Moreover, by providing a reflecting layer, a coloring film, a phosphor film, etc. on the jacket bulb, a lighting efficiency of the discharge lamp can also be improved. Thereby the discharge lamp can be used for various purposes.

A luminaire according to still another aspect of the invention comprises the high-pressure discharge lamp defined in any one of preceding aspects, a luminaire main-body mounting thereon the high-pressure discharge lamp, a lighting circuit equipped in the luminaire main-body for lighting the high-pressure discharge lamp.

Here, in this application, the term "luminaire" has a wide concept containing all of such devices using lights radiated by high-pressure discharge lamps for any purpose. For example, the luminaire according to this aspect of invention is able to be applied for incandescent-lamp shaped high-pressure discharge lamps, lighting equipment, mobile-use head-lights, optical fiber-use light sources, image projectors, photo-chemical devices, fingerprint discriminators, etc.

Here, the term "luminaire main-body" means reminders of the luminaire from that the high-pressure discharge lamp is removed. Here, the term "incandescent-lamp shaped high-pressure discharge lamp" means a luminaire in which a high-pressure discharge lamp and a stabilizer thereof are integrated together, and a bulb-base is added thereto for receiving a commercial power. By loading the bulb-base to a corresponding lamp socket, this type of lamp device is used as if it is an incandescent lamp.

The luminaire can be equipped with light-governors, such as lenses, filters, optical diffusion covers, etc. for governing and protecting the light intensity and light distribution of the discharge lamps, reflectors or housings.

The luminaire main-body and the lighting circuit may be formed in integral, or may be formed separately.

The lighting circuit may be either of a high frequency AC type, low frequency AC type or a DC type.

Additional objects and advantages of the present invention will be apparent to persons skilled in the art from a study of the following description and the accompanying drawings, which are hereby incorporated in and constitute a portion of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention will be described in detail with reference to the FIGS. 1–8.

Figure 1:
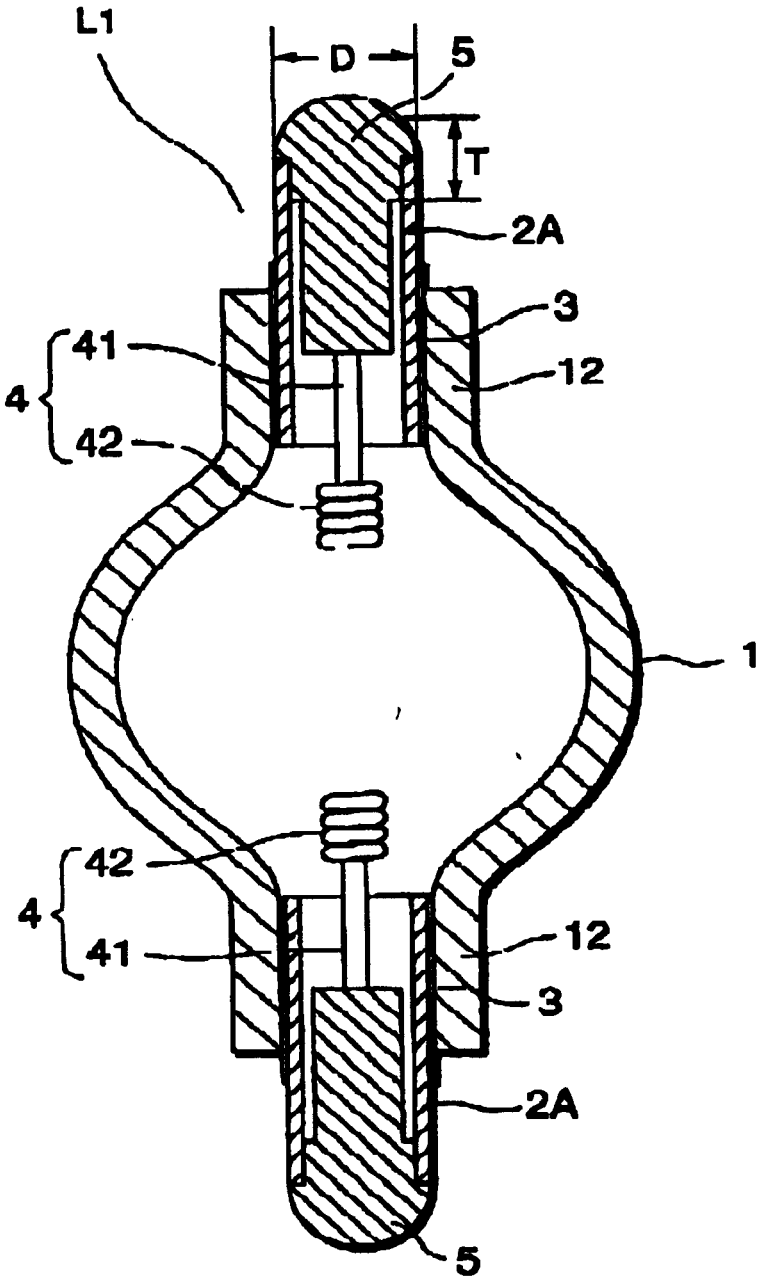
FIG. 1 is a partial front section of a first embodiment of the high-pressure discharge lamp according to the present invention.
Figure 2A:
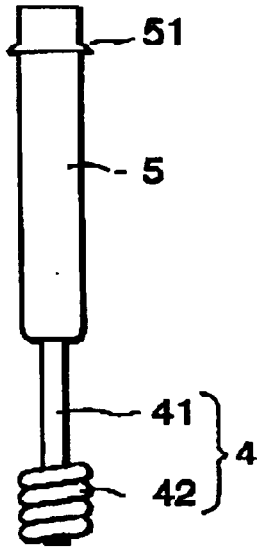
FIGS. 2A–2D are front views showing various aspects of fusible metal plug equipped with an electrode system.
Figure 2B:
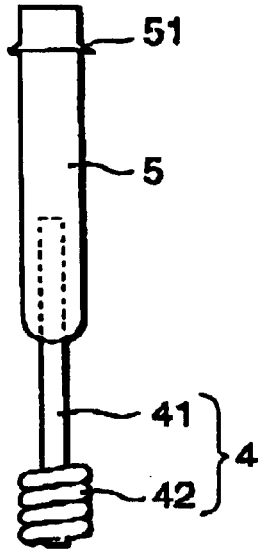
Figure 2C:
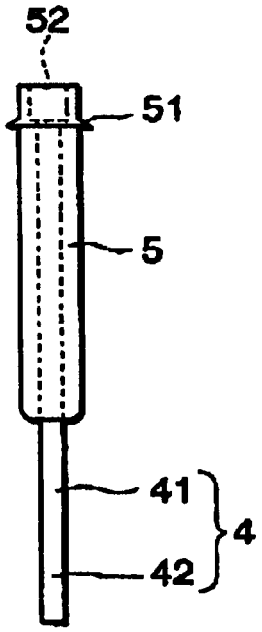
Figure 2D:
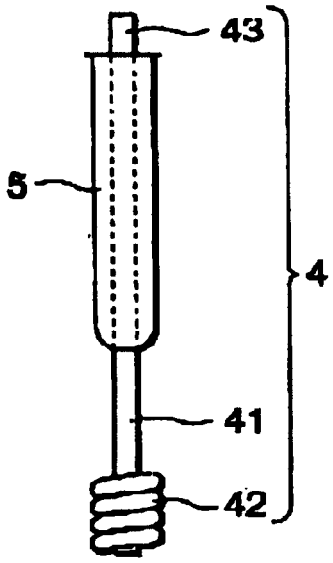
Figure 3:
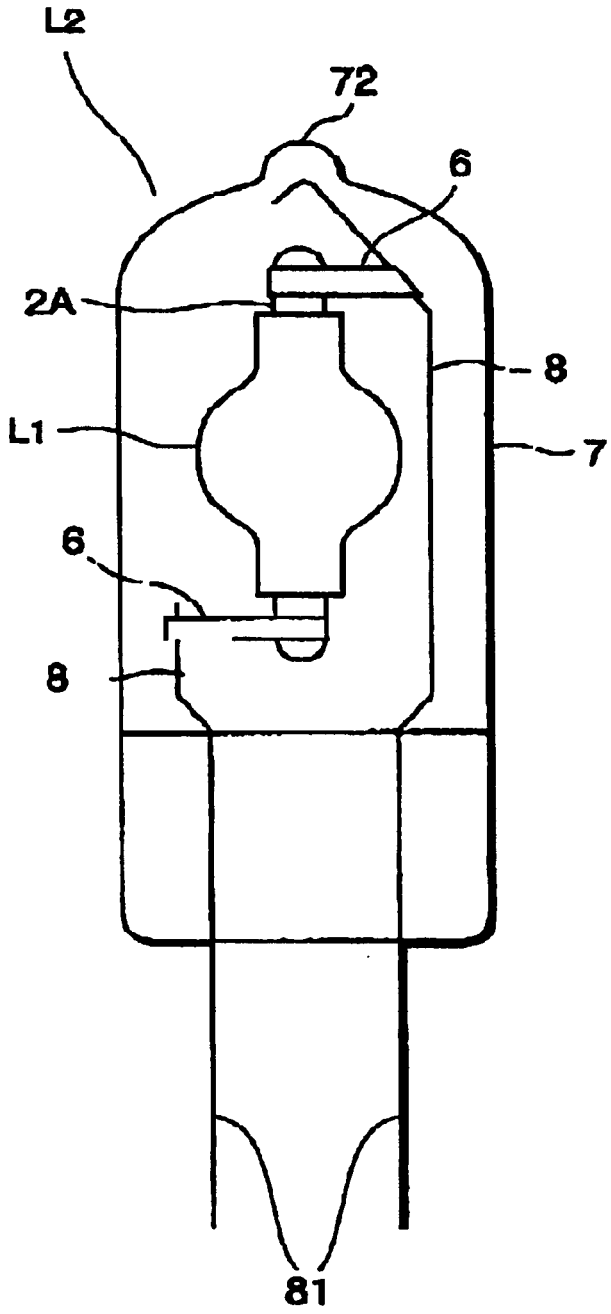
FIG. 3 is schematic front view showing an embodiment of the double-bulb type high-pressure discharge lamp according to the present invention.

Referring now to FIGS. 1–3, a first embodiment of the high-pressure discharge lamp according to the present invention will be explained. FIG. 1 is a partial front section of a first embodiment of the high-pressure discharge lamp according to the present invention. FIGS. 2A–2D are front views showing various aspects of fusible metal plug equipped with an electrode system. FIG. 3 is schematic front view showing an embodiment of the double-bulb type high-pressure discharge lamp according to the present invention.

In FIG. 1, the high-pressure discharge lamp L1 comprises a translucent ceramic discharge vessel 1, metal tubes 2A, 2A, junction layers 3, 3, a pair of electrode systems 4, 4, a pair of fusible metal plugs 5, 5, and ionizing filling (not shown). Here, the high-pressure discharge lamp is also referred to as an arc tube.

The discharge vessel 1 is made of translucent alumina ceramics, and comprised of a swollen portion 11 and a pair of cylindrical portions 12, 12. The swollen portion 11 has a spherical shape with a wall-thickness of about 0.5 mm and a maximum outer diameter of about 6 mm. The cylindrical portions 12, 12 extend in the opposite directions with each other from opposite ends of the swollen portion 11. The base ends of the cylindrical portions 12, 12 join the swollen portion 11 with a continual surface change. The cylindrical portions 12, 12 are each shaped in a size having an outer diameter of about 2.7 mm and a length of about 1.5 mm. The overall length of the discharge vessel 1 is about 20 mm, including the cylindrical portions 12, 12.

Into the cylindrical portions 12, 12, the metal tubes 2A, 2A made of Molybdenum each shaped in a size having a wall-thickness of about 0.15 mm, an outer diameter D of about 1 mm and a length of about 5 mm are fit. Wherein the metal tubes 2A, 2A expose outside the cylindrical portions 12, 12 by about 2 mm length. The inner surface of the cylindrical portion 12 and the outer surface of the metal tube 2A are hermetically joined with each other through a junction layer 3 made of porous cermet as a major component which is formed by sintering a major mixture of Molybdenum powder and alumina-ceramics powder and frit glass impregnated in the voids of the porous cermet.

The electrode systems 4, 4 are each comprised of an electrode rod 41 and an electrode 42. The electrode rod 41 is shaped in a size having an outer diameter of about 0.2 mm and an overall length of about 4 mm from Tungsten wire. One end of the electrode rod 41 is supported with the fusible metal plug 5 by being welded or embedded thereto. The electrodes 42, 42 are formed on the other ends of the electrode rods 41, 41 so as that they face the interior of the swollen portion 11. The electrodes 42, 42 are each coiled by four turns of Tungsten wire in a shape having an outer diameter of about 0.15 mm. The electrodes 42, 42 face each other at a gap of about 3 mm.

The discharge vessel 1 is filled with ionizing filling including about 0.4 mg of halide, about 0.21 mg of mercury and about 26.7 Pa of rare gas. The halide contains 70 mass % of NaI3, 10 mass % of TlI, and 20 mass % of DyI3. The rare gas filling is a mixture of about 97 volume % of Ne and about 3 volume % of Ar.

Now a manufacturing process of the high-pressure discharge lamp L1 will be described. First, the translucent ceramic discharge vessel 1 comprised of the swollen portion 11 and the cylindrical portions 12, 12 connected to the opposite ends of the swollen portion 1, the pair of metal tubes 2A, 2A made of Molybdenum, and the columnar fusible metal plugs 5, 5 made of platinum and each suspending the electrode system 4 as shown in FIG. 2, are prepared.

The fusible metal plug 5 and the electrode system 4 are coupled with each other, in either aspect of the sub-assembly as shown FIGS. 2A–2D. In the aspect of the sub-assembly as shown in FIG. 2A, one end of the electrode rod 41 of the electrode system 4 is abutting-welded to the end of the columnar fusible metal plug 5 thinner than the inner diameter of the cylindrical portion 12. In the drawing, the numeral 51 denotes a stop ring formed on the outer surface of the columnar fusible metal plug 5.

In the aspect of the sub-assembly as shown in FIG. 2B, the one end of the electrode rod 41 of the electrode system 4 is embedded to the end of the columnar fusible metal plug 5 with the same shape as that shown in FIG. 2A.

In the aspect of the sub-assembly as shown in FIG. 2C, a through-hole 52 having a counter-bore at its upper end as shown in the drawing is previously defined in the fusible metal plug 5. Then the one end of the electrode rod 41 of the electrode system 4 is inserted into the through-hole 52 until a head portion of the electrode rod 41 engages in the counter-bore.

In the aspect of the sub-assembly as shown in FIG. 2D, the electrode rod 41 of the electrode system 4 penetrates the fusible metal plug 5 so as that a portion of the electrode rod 41 is projected from the top end of the fusible metal plug 5 and making an outer feeding conductor 43. In each of the above aspects, the fusible metal plug 5 is principally made of platinum vanadium, or Molybdenum and shaped in size having an outer diameter of about 0.65 mm and a length of about 5 mm.

A sealing compound comprising a cermet or a ceramic sealing compound is previously applied on the inner surfaces of the cylindrical portions 12, 12 or the outer surfaces of the metal tubes 2A, 2A.

The metal tube 2A is fit in the upper cylindrical portion 12 of the discharge vessel 1 which is laid in the vertical position. Then the periphery of the cylindrical portion 12 is heated with an electric heater made of Tungsten to fuse the sealing compound. And then the metal tube 2A and the upper cylindrical portion 12 are hermetically sealed and a sealing compound is fused, both after the fusion-sealing compound has solidified. Then, the discharge vessel 1 is turned upside down, and the other metal tube 2A is fit in the other cylindrical portion 12 now positioned in upper side in the drawing, and the sealed in the similar manner as described above.

Then, the sub-assembly as shown in FIGS. 2A–2C is inserted in the metal tube 2A fit in the cylindrical portion 12 of the discharge vessel 1 now located in the upper vertical position. The stop ring formed on the outer surface of the fusible metal plug 5 engages with the upper edge of the metal tube 2A. Consequently the fusible metal plug 5 exposes from the metal tube 2A by about 0.2–1.0 mm.

Then a YAG laser beam etc., is applied to the exposed portion of the fusible metal plug 5 and the periphery of the open end of the metal tube 2A for a short time, e.g., tens of milliseconds. Thereby, a part of the fusible metal plugs 5 is fusion-bonded to the inner surface of metal tube 5 at the periphery of the open end of the metal tube 5*a*. Therefore, the open end of the metal tube 2A is closed, while the electrode system 4 is supported in the discharge vessel 1.

In the case of the sub-assembly as shown in FIG. 2C, the gap between the electrode system 4 and the through-hole 52 of the fusible metal plug 5 must be also sealed. Therefore, low melting point fusible metal is used for the fusible metal plug 5, or a higher temperature healing must be applied. In the case of the sub-assembly as shown in FIG. 2D, the outer feeder conductor 43 protruded from the fusible metal plug 5 must be avoided from fusion. Therefore, it is desirable to use low melting point fusing metal for the fusible metal plug 5.

The sealing process is carried out in a bell jar maintained in a hermetically closed condition.

Thus, the outer open ends of the metal tubes 2A, 2A exposed from the cylindrical portions 12, 12 are hermetically closed with the fusible metal plugs 5, 5. At this time, the height T of the portion of the fusible metal plug 5 fusion-bonded to the inner surface of the metal tube 2A from the outer end of the fusible metal plug 5 was about 0.7 mm.

Further, in the case as shown in FIG. 3, a double-bulb type high-pressure discharge lamp L2 is achieved by enclosing the high-pressure discharge lamp L1 achieved according to the manufacturing process as described above. In the double-bulb type high-pressure discharge lamp L2, the jacket bulb 7 is made of alumina silicate glass and formed in a cylindrical shape in a size having an outer diameter of about 12 mm and an overall length of about 36 mm. In this double-bulb type high-pressure discharge lamp L2, support members 6, 6 in the form of a tantalum wire or a tantalum foil are fixed by welding to the outer surfaces of the metal tubes 2A, 2A at the opposite ends of the high-pressure discharge lamp L1.

Figure 8:
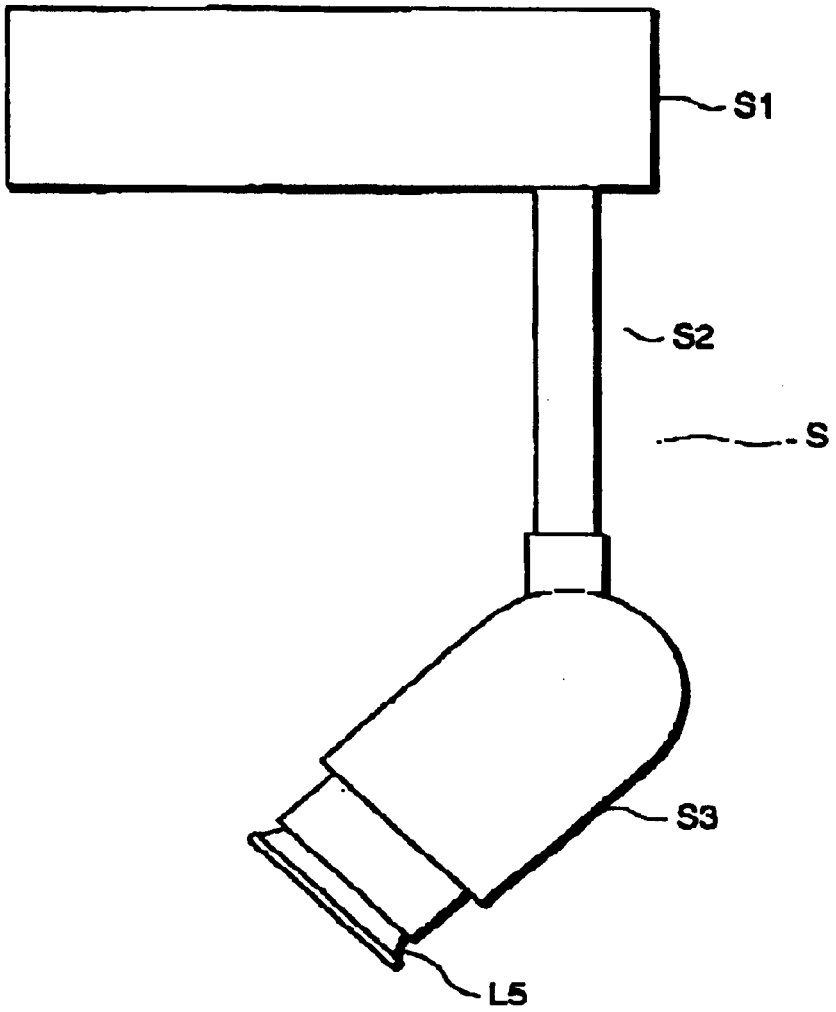
FIG. 8 is a front view showing a spotlight according to the present invention.

In FIG. 8, the numeral 8 denotes a lead wire made of Molybdenum. The lead wires 8, 8 penetrate a press-sealed portion 71 of the jacket bulb 7. The, portions of lead wires 8, 8 in the jacket bulb 7 are electrically coupled to the lead wires 6, 6, and mechanically support the high-pressure discharge lamp L1. After the jacket bulb 7 has been evacuated through an exhaust pipe 72, the exhaust pipe 72 is pinched off and thus the interior of the jacket bulb 7 is held evacuated. Moreover, the portions 81, 81 of lead wires 8, 8 protruding outside the jacket bulb 7 are connected to a bulb-base or a feeding element (both not shown).

In the double-bulb type high-pressure discharge lamp L2, an electric current is fed from an inverter type high frequency lighting circuit apparatus (not shown) through a feeder, a socket and a feeder member in the order. The electric current is then transmitted in the order of the outer lead wires 81, the inner lead wire 8, the support member 6, the metal tube 2A, the fusible metal plug 5, the electrode rod 41 and the electrode 42. Thus a discharge takes place across the pair of electrodes 42, 42 and emits light.

The double-bulb type high-pressure discharge lamp L2 has lamp characteristics, such as a lamp voltage of around, 75 V, a lamp current of around 0.25 A, lamp wattage of around 20 W and a bulb-wall load of around 28 W/cm$^2$.

Moreover, voids had not occurred in the fusible metal plug 5 plugged in the open end of metal tube 2A established in the discharge vessel 1, and this high-pressure discharge lamp L2 had not been suffered by any exfoliation of the fused interface from the metal tube 2A, either, and has maintained the airtight closing.

Since the fusion aspect of the fusible metal plug 5 plugging the open end of the mental tube 2A of the arc tube L1 varies according to its material, fusing temperature, volume (i.e., heat capacity) and heating condition, etc., the aspect of the fusion-bonding to the inner surface of the metal tube 2A will take various aspects (patterns) as shown in FIGS. 4A–4F.

Although in the ratio T/D the height T is given by the height from the outer end of the fusible metal plug 5 to the end of the portion which is fusion-bonded and then solidified to the inner surface of the metal tube 2A.

Referring now to FIGS. 4A–4F, various aspects of the fusion-bonding of the fusible metal plug 5 to the inner surface of the metal tube 5 where the height T is specified will be explained. In the drawings, the numeral 54 denotes the end of the fusion-bonded portion of the fusible metal plug 5 to the inner surface of the metal tube 2A. The numeral 55 denotes the upper end face of the fusible metal plug 5 intercepting the virtual line 56 extending along the inner surface of the metal tube 2A.

Although the end 54 of the fusion-bonded portion of the fusible metal plug 5 varies in the circumferential direction, it is adopted from a least fluctuating portion or averaged location.

Figure 4A:
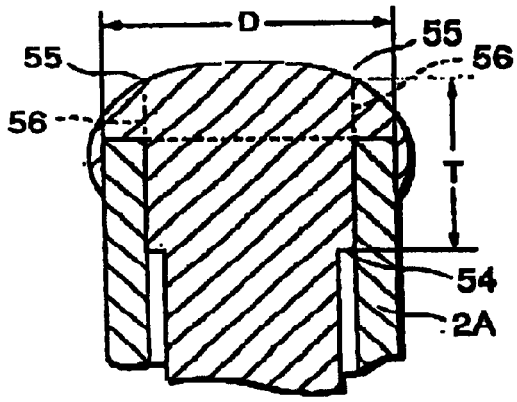
FIGS. 4A–4F are longitudinal sections showing various fused aspects of the fusible metal plug to the inner surface of the metal tube.

FIG. 4A shows a most preferable aspect wherein a fused portion of the fusible metal plug 5 flows down along the inner surface of the metal tube 2A to the extent as marked by the numeral 54, while the once fused top portion of the fused metal plug 5 presents a round surface due to its surface tension and then solidified as it is.

Figure 4B:
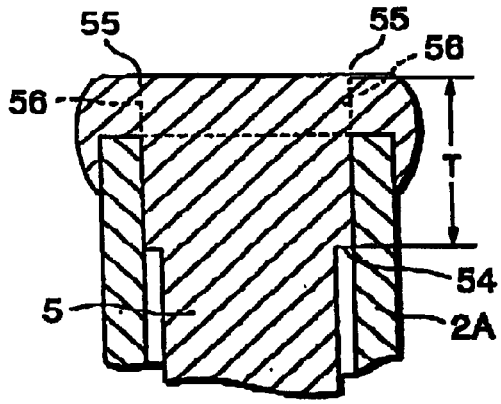

FIG. 4B shows another aspect wherein the fused top portion of the fused metal plug 5 once presents a round surface due to its surface tension and then pressed smoothly by a flat press.

Figure 4C:
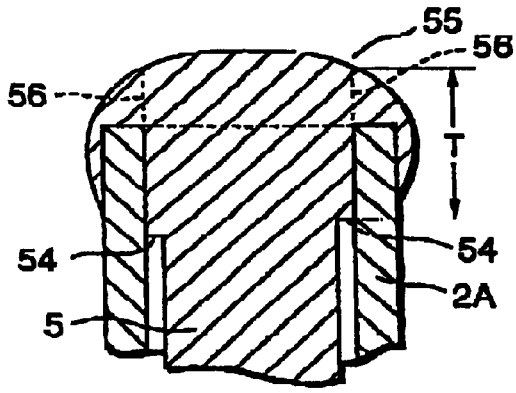

FIG. 4C shows still another aspect wherein the once fused top portion of the fused metal plug 5 presents a round surface due to its surface tension and then solidified as it is, while the lower fusion-bonded end 54 varies in the in the circumferential direction. In this aspect, the lower fusion-bonded end 54 in most raised portion is adopted.

Figure 4D:
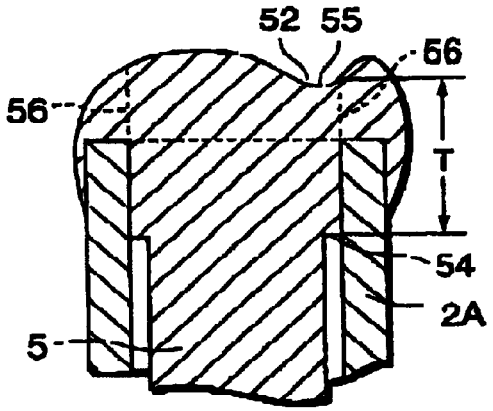
Figure 4E:
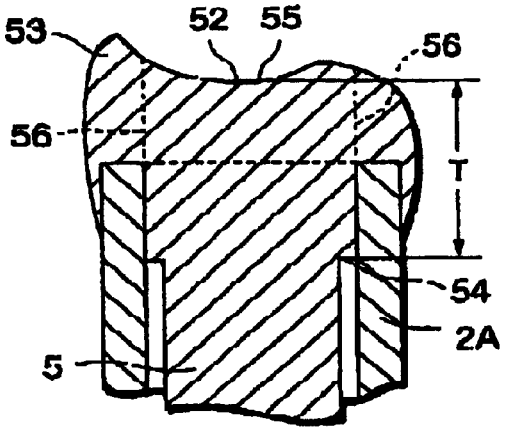

FIGS. 4D and 4E, show still other aspects wherein a recession 52 is defined on the top end surface of the fused metal plug 5 due to due to misalignment of heating laser beam or excess heating. In these aspects, the location 56 of the upper end face of the fusible metal plug 5 is adopted at the lowest portion of the recession 52.

Figure 4F:
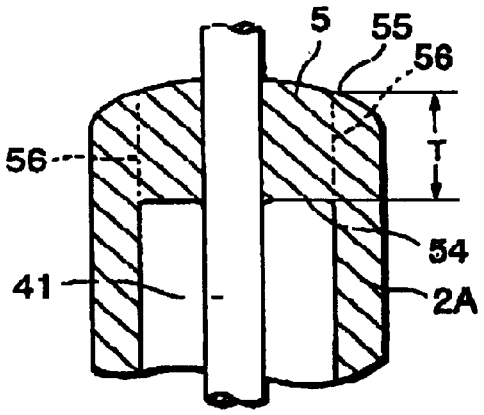

FIG. 4F shows still another aspect wherein the metal tube 2A made of fusible metal such as Molybdenum serves as the fusible metal plug 5. In this aspect, the discharge vessel is sealed by fusing the upper end of the fusible metal tube 2A, and then the electrode rod 41 made of Tungsten is fixed by the sealed portion. In this aspect, the portion 55 of the sealed upper end of the metal tube 2A is defined on the portion intercepting the virtual line 56 extending along the inner surface of the metal tube 2A.

Generally, in such high-pressure discharge lamps with those aspects of fusion-sealings, the fusible metal plug 5 exfoliates due to a difference of the thermal-expansion coefficient from the metal tube 2A. Also, voids taking place in the fusible metal plug 5 communicate each other and thus there take place leaks. And also cracks take place due to degradation of the fusible metal plug 5 by erosion of halide in the ionizing fillings. Here, it is supposed that the life of a high-pressure discharge lamp is influenced by the leaks or the cracks. Then, the inventors have investigated the relation of the height T and the outer diameter D around the fused-sealing portion to the life of a high-pressure discharge lamp.

That is, in order to search a condition of eliminating voids in the fusible metal plug 5 or its exfoliation, a ratio T/D of the outer diameter D of the metal tube 2A and the height T concerning the fusible metal plug 5 was investigated. Table 1 shown in below presents the result of the investigation.

First, prepared some samples of metal halide lamps manufactured according to the structure, the material and the size of the above-described high-pressure discharge lamp L2, a 2000 hours of rated life, the diameter D of various values in the range of 0.6–1.6 mm, the height T of various values. Then survival rate (%) after 100-hour lighting of the samples were measured by applying 130% excess-voltage of the rated lighting voltage. The survival rate (%) under such lighting voltage corresponds to actual survival rate under a rated lighting voltage.

TABLE 1

| T/D | 0.3 | 0.35 | 0.4 | 0.55 | 0.7 | 0.85 | 0.9 | 1.0 | 1.1 |
|---|---|---|---|---|---|---|---|---|---|
| Survival rate (%) after 100-hour lighting | 60 | 70 | 92 | 96 | 96 | 94 | 88 | 65 | 60 |

As seen from the Table 1, when the ratio T/D of the height T concerning the fusible metal plug 5 to the outer diameter D of the metal tube 2A was 0.4–0.95, 80% or more of survival rate was assured. This is obliged to the fact that exfoliations caused by thermal-expansion coefficient difference of the fusible metal plug 5 and the metal tube 2A after 130% excess-voltage impression 100-hour lighting and the leaks by the voids birth in the fusible metal plug 5 decreased, 80% or more of survival rate was assured, and shortening of a lamp life was able to be inhibited.

If the ratio T/D is less than 0.4, voids taking place in the fusible metal plug 5 by any reason communicate each other. Thus there arises a fear of that leaks take place. If the ratio T/D is in excess of 0.95, the height T concerning the fusible metal plug 5 may become too high. Then it arises a fear of causing exfoliations by the thermal-expansion coefficient difference between the metal tube 2A and the fusible metal plug 5. Since heat capacity became large and temperature of the fusible metal plug 5 was not able to rise easily, a possibility that a fusible metal and a metal tube might not fuse enough, but might produce leaks from the interface increased, the survival rate fell off to less than 80%, and the desirable life was acquired for neither of the cases.

When a dispersion of the ratio T/D is taken account, the desirable range of the ratio T/D must be in the range of 0.4–0.85. While most desirable range of the ratio T/D is 0.55–0.75.

The reason that the desirable survival rate is taken as 80% or more is because it corresponds to 95% or more of survival rate, if it is converted into normal lighting of 2000 hours at a rated lighting voltage operation.

Further, prepared some samples of mercury-less double-bulb type high-pressure discharge lamps manufactured according to the structure, the material and the size of the above-described high-pressure discharge lamp L1, and various type of ionizing filling changed. Then survival rate (%) after 100-hour lighting of the samples were measured by applying 130% excess-voltage of the rated lighting voltage. Then, similar results as the case of the high-pressure discharge lamp L2 ware achieved.

The discharge vessel 1 of this high-pressure discharge lamp is filled with halide of about 0.8 mg, ZnI2 of about 0.4 mg and Xe gas of about 100 Pa, as ionizing filling. Wherein the halide is comprised of NaI3 of 70 mass %, TlI of 10 mass % and DyI3 of 20 mass %.

While, the double-bulb type high-pressure discharge lamp had lamp characteristics, such as a lamp voltage of around 40 V, a lamp current of around 0.52 A, lamp wattage of around 20 W and a lamp efficiency of around 70 lm/W.

Figure 5:
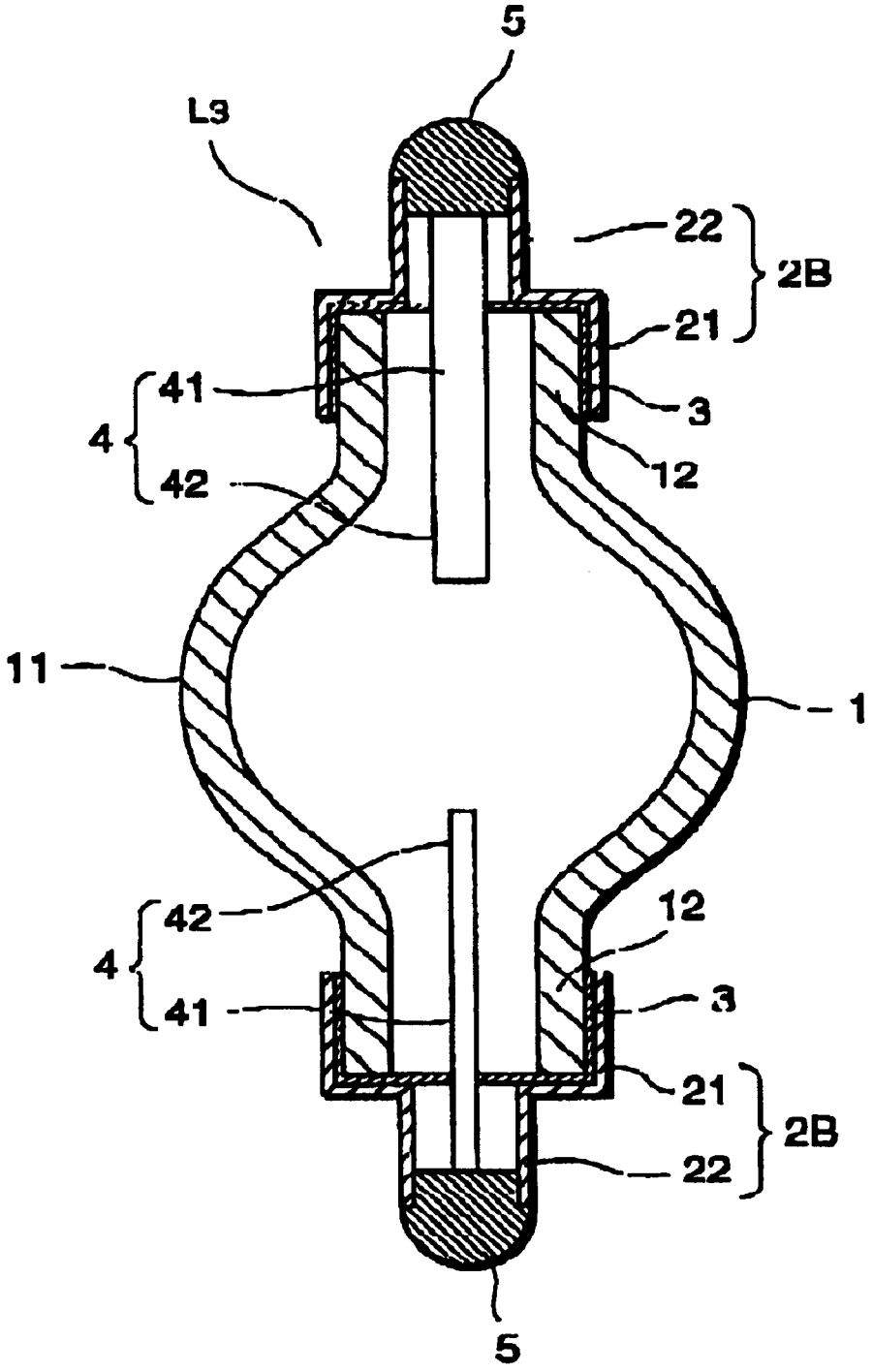
FIG. 5 is a front section showing a second embodiment of the high-pressure discharge lamp according to the present invention.

Referring now to FIG. 5, a second embodiment of the high-pressure discharge lamp according to the present invention will be explained. In FIG. 5, the same elements as those shown in FIG. 1 are assigned with the like reference numerals and not discussed herein.

In the high-pressure discharge lamp L3, the outer surfaces of the metal tubes 2B, 2B are defined in two-step surface with the thick portion 21 and the thin portion 22. The thick portion 21 is fit on the outer surface of the cylindrical portion 12. Then the metal tubes 2B, 2B are hermetically joined to the cylindrical portions 12, 12 with a junction layer 3 made of cermet and frit glass impregnated in the cermet constituting major constituent. The open end of the thin portion 22 is plugged with a fusible metal plug 5 with an electrode system 4, in similar to the first embodiment as described above.

In this embodiment of the electrode system 4, one end of the electrode rod 41 serves as the electrode 42 as it is. The pair of electrode systems 4, 4 facing each other are constituted in asymmetrical by being differentiated their diameter. For example, one electrode 4 has a diameter of about 0.6 mm, while the other electrode 4 has a diameter of about 0.15 mm. These asymmetrical electrodes 4, 4 are suitable for constituting DC lighting type lamps. However, the electrode systems 4, 4 may be the configuration the same as that in the first embodiment.

Figure 6A:
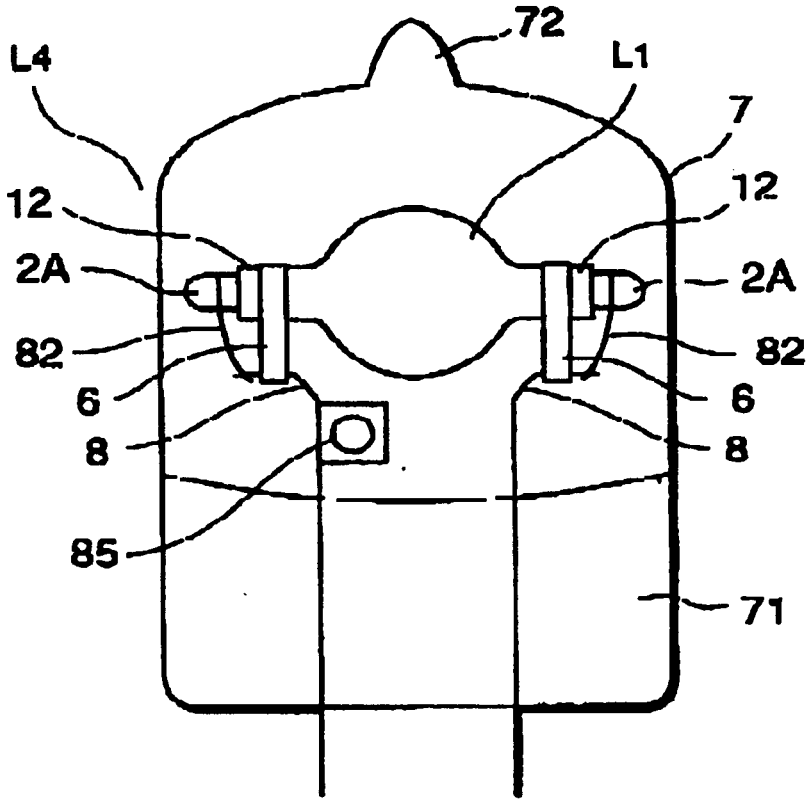
FIGS. 6A and 6B are schematic front view and a partial side elevation view showing another embodiment of the double-bulb type high-pressure discharge lamp according to the present invention.
Figure 6B:
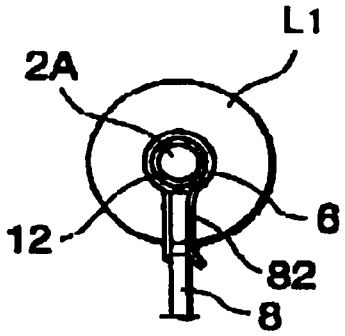
Figure 7:
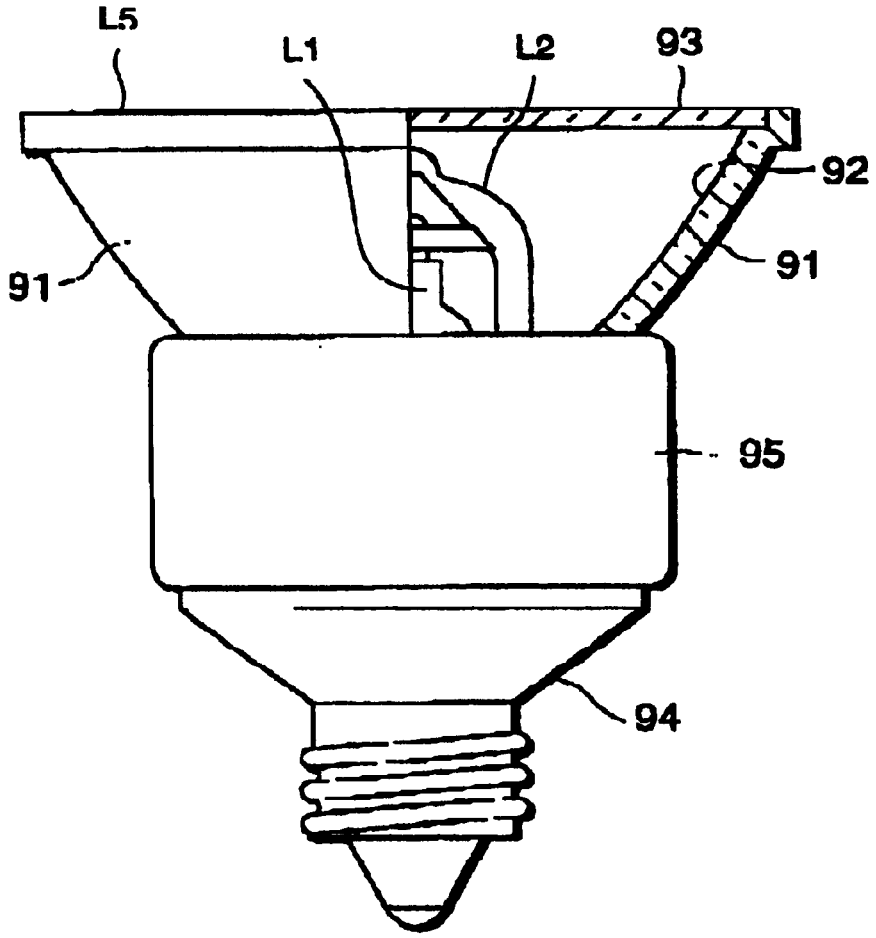
FIG. 7 is a partial cut-away front section showing still another embodiment of the high-pressure discharge lamp according to the present invention.

Referring now to FIGS. 6A, 6B and 7, further embodiments of the high-pressure discharge lamp according to the present invention will be explained. In FIGS. 6A and 6B, the same elements as those shown in FIG. 3, are assigned with the like reference numerals and not discussed herein.

FIGS. 6A and 6B show a double-bulb type high-pressure discharge lamp L4 in which the discharge lamp L1 is enclosed in the direction orthogonal to the center axis of the jacket bulb 7. In this high-pressure discharge lamp L4, the jacket bulb (T-type jacket bulb 7 is shaped in a size having an outer diameter of about 30 mm and an overall length of about 40 mm. The jacket bulb 7 then encloses a discharge lamp (arc tube L1 shaped in a size having a maximum diameter of about 6 mm and an overall length of about 22 mm.

Since the discharge lamp L1 is aligned in the direction orthogonal to the center axis of the jacket bulb 7, the discharge lamp L4 has an advantage of that the overall length is highly reduced. Therefore, the flexibility for installing this type of discharge lamp into luminaire will increase. As a consequence, this type of discharge lamp is advantageously able to promote a miniaturization of elements such as the reflector.

In this double-bulb type high-pressure discharge lamp L4, it is desirable that ratio GD/GL of the outer diameter GD to the length GL of the major portion of the jacket bulb other than the sealing portion 71 and the exhaust pinch-off portion 72 is equal to or larger than 0.6.

By the ratio GD/GL being equal to or larger than 0.6, the overall length of the double-bulb type high-pressure discharge lamp L4 is effectively reduced, in comparison to the case of the double-bulb type high-pressure discharge lamp L2 as shown in FIG. 3.

Moreover, in this double-bulb type high-pressure discharge lamp L4, as shown in FIGS. 6A and 6B, the lamp L1 is supported in the jacket bulb 7 by support members 6, 6 in forms of foils of metal such as Tantalum at the positions highly close to the swollen portion 11 of the discharge vessel 1. Here, the support members 6, 6 are wound their one ends around the periphery of cylindrical portions 12, 12 at the positions close to the swollen portion 11, as described above. The other ends of the swollen members 6, 6 are fixed by welding or caulking to lead wires 8, 8 for feeding electricity to the lamp L1. As the lamp L1 being supported so firmly, the double-bulb type high-pressure discharge lamp L4 is able to have a favorable vibration proof, in comparison to the double-bulb type high-pressure discharge lamp L2, as shown in FIG. 3, in which the lamp L1 is supported at its metal tubes 2A, 2A distant from the swollen portion. Here, in FIGS. 6A and 6B, the numeral 82 denotes other lead wires for electrically connecting between the lead wires 8, 8 and the metal tubes 2A, 2A, while the numeral 85 denotes a getter.

Referring now to FIG. 7, still another embodiment of the high-pressure discharge lamp according to the present invention will be described. More particularly, FIG. 7 shows a reflection type discharge lamp L5. In this reflection type discharge lamp L5, a reflector 91 is made of hard glass, such as borosilicate glass. The inner surface 92 of the reflector 91 forms paraboloid of revolution or ellipsoid of revolution. Moreover, the inner surface 92 is provided with a multi-layered interference film such as a dichroic mirror or a total reflection film. In front of the reflector 91, a light-governor 93 such as a lens or a front cover is mounted. Here, the light-governor 93 can be formed in integral with the reflector 91.

In the reflection type discharge lamp, either of the aforementioned single-bulb type high-pressure discharge lamp L1 or L3 or the double-bulb type high-pressure discharge lamp L2 or L4 can be employed. By the way, the lamp L1, L2, L3 or L4 is placed its center on the focus of the reflector 91.

When the single-bulb type high-pressure discharge lamp L1 or L3 is employed, it is desirable that the reflector 91 and the light-governor 98 form together a hermetically scaled enclosure. When the double-bulb type high-pressure discharge lamp L2 or L4 is employed, an enclosure formed by the reflector 91 and the light-governor 98 may not be hermetical.

Moreover, a conical skirt 95 of the bulb-base 94 is fixed to the back of the reflector 91 by caulking or adhesion. The bulb-base 94 is electrically coupled to the lamp through a lead wire (not shown). The bulb-base 94 can accommodate therein a lighting circuit.

When the reflection type discharge lamp L5 is turned ON, the high-pressure discharge lamp L1 emits light. Then the emitted light is radiated forward directly or indirectly by being reflected at the reflector 91. Thus the reflection type discharge lamp L5 is also able to exert meritorious effects similar to those as described above. Thus, the reflection type discharge lamp L5 is able to light without any trouble.

The reflection type discharge lamp L5 is advantageously compact in size and faster in the rising time of the luminous flux at the start of operation. Therefore, the reflection type discharge lamp L5 is suitable for, e.g., headlights, or display-lights for lighting articles.

Referring now to FIG. 8, a spotlight as an embodiment of the luminaire according to the present invention will be explained. This spotlight comprises a spotlight body S and the reflection type high-pressure discharge lamp L5 as described above.

The spotlight body S is typically equipped with a luminaire track attachment S1, an arm S2, and a head portion S3. The luminaire track attachment S1 accommodates therein a lighting circuit (not shown), while it is removably attached in a luminaire track (not shown) and thus suspends the other part of the spotlight. The lighting circuit receives electricity from the luminaire track. The arm S2 is fixed at its base to the luminaire track attachment S1. The head portion S3 is pivoted on the free-end of the arm S2 in freely rockable in both vertical plane and horizontal plane. The head portion S3 is shaped in a form of front open enclosure. On the depth of the head portion S3 a screw lamp socket (not shown) is fixed. Then the reflection type high-pressure discharge lamp L5 is mounted to the screw lamp socket.

In the spotlight according to the present invention, the high-pressure discharge lamp L1 enclosed in the reflection type high-pressure discharge lamp L5 exerts meritorious effects similar to those as described above. Therefore, the spotlight is able to exert effective lighting without any trouble suffered in the conventional lamps.

According to one aspect of the invention, the ratio T/D of the outer diameter D of the metal tube fit to the cylindrical portion of the discharge vessel and the height T concerning the fusible metal plug plugged in the open end of the metal tube is defined in a particular range. Thus it is able to provide a long life high-pressure discharge lamp wherein leaks resulting from the voids produced in exfoliation by thermal-expansion coefficient difference of the fusible metal plug and the metal tube are effectively reduced.

According to another aspect of the invention, the corrosion resistance of the metal tube to ionizing filling can be extensively improved. Therefore, a high-pressure discharge lamp having a high hermeticity between the metal tube and the translucent ceramic discharge vessel can be achieved.

According to still another aspect of the invention, a high-pressure discharge lamp by which the aspect of fusion-bonding between a fusible metal plug and a metal tube is retained well can be achieved.

According to still another aspect of the invention, a high-pressure discharge lamp by which the aspect of fusion-bonding between the fusible metal plug and the metal tube is retained well can be also achieved.

According to still another aspect of the invention, the thermal-expansion coefficient difference of the metal tube and the fusible metal plug becomes small. Therefore a high-pressure discharge lamp with less exfoliation by thermal shock can be achieved.

According to still another aspect of the invention, a high-pressure discharge lamp wherein an oxidization of elements in the translucent ceramic discharge vessel caused by temperature rise during lighting of the lamp or a corruption of the translucent ceramic discharge vessel is effectively prevented can be achieved.

According to still another aspect of the invention, a luminaire with long life property and less trouble of exchanging lamp, thus easy for maintenance can be achieve.

As described above, the present invention can provide an extremely preferable high-pressure discharge lamp and a luminaire using such a high-pressure discharge lamp.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

The foregoing description and the drawings are regarded by the applicant as including a variety of individually inventive concepts, some of which may lie partially or wholly outside the scope of some or all of the following claims. The fact that the applicant has chosen at the time of filing of the present application to restrict the claimed scope of protection in accordance with the following claims is not to be taken as a disclaimer or alternative inventive concepts that are included in the contents of the application and could be defined by claims differing in scope from the following claims, which different claims may be adopted subsequently during prosecution, for example, for the purposes of a divisional application.

What is claimed is:

1. A high-pressure discharge lamp comprising:

a translucent ceramic discharge vessel having a swollen portion defining a discharge space and a pair of cylindrical portions formed in and communicating with the swollen portion and extending from the swollen portion in the opposite directions with each other, metal tubes each having an outer diameter D and fit with its one end on the cylindrical portion;

a pair of fusible metal plugs each plugged in the outer end of the metal tube, the fusible metal plug sealing the discharge vessel by being fused to the inner surface of the metal tube for a specified height T, wherein the height T corresponds to the height of that portion of the metal plug where the diameter of the plug is greater than or equal to the inner diameter of the metal tubes;

a pair of electrode systems each supported its one end to the fusible metal plug and facing the interior of swollen portion with its other end; and ionizing filling filled in the discharge vessel;

wherein the ratio T/D of the height T concerning the fusible metal plug and the diameter D satisfies the following equation $0.40 \leqq T/D \leqq 0.95$.

2. A high-pressure discharge lamp according to claim 1, wherein the metal tube is principally made of high melting point metal selected from the group consisting of Tungsten or Molybdenum.

3. A high-pressure discharge lamp according to claim 1, wherein the diameter D is in the range 0.6–1.6 mm.

4. A high-pressure discharge lamp according to claim 1, wherein the height T concerning the fusible metal plug is in the range of 0.24–1.5 mm.

5. A high-pressure discharge lamp according to claim 1, wherein the fusible metal plug is principally made of fusible metal selected from the group consisting of Platinum, Vanadium or Molybdenum.

6. A high-pressure discharge lamp according to any one of claims 1 to 5, further comprising a heat-resistive and translucent jacket bulb enclosing therein the translucent ceramic discharge vessel sealed with the metal tube and the fusible metal plug.

7. A luminaire comprising the high-pressure discharge lamp as defined in claim 1, a luminaire main-body mounting thereon the high-pressure discharge lamp, and a lighting circuit equipped in the luminaire main-body for lighting the high-pressure discharge lamp.

8. A luminaire comprising the high-pressure discharge lamp as defined in claim 6, a luminaire main-body mounting thereon the high-pressure discharge lamp, and a lighting circuit equipped in the luminaire main-body for lighting the high-pressure discharge lamp.

* * * * *